US006279804B1

(12) United States Patent
Gregg

(10) Patent No.: US 6,279,804 B1
(45) Date of Patent: Aug. 28, 2001

(54) STRAP ATTACHMENT SYSTEM

(76) Inventor: Ron Gregg, 2716 NE. 106$^{th}$ Pl., Seattle, WA (US) 98125

( * ) Notice: Subject to any disclaimer, the term of this patent is extended or adjusted under 35 U.S.C. 154(b) by 0 days.

(21) Appl. No.: 09/369,075

(22) Filed: Aug. 5, 1999

Related U.S. Application Data

(60) Provisional application No. 60/095,819, filed on Aug. 6, 1998.

(51) Int. Cl.$^{7}$ ..... A45F 5/00

(52) U.S. Cl. ..... 224/675; 224/250; 224/651; 2/255; 2/338; 24/306

(58) Field of Search ..... 224/674, 675, 224/250, 651, 576; 24/306, 442, 30.5 P; 2/255–260, 338

(56) References Cited

U.S. PATENT DOCUMENTS

| | | | | |
|---|---|---|---|---|
| 2,379,128 | * | 6/1945 | Wilson | 24/309 X |
| 3,241,881 | * | 3/1966 | Carnahan | 24/306 X |
| 3,874,034 | * | 4/1975 | Clayton | 24/30.5 P |
| 5,048,734 | * | 9/1991 | Long | 224/675 X |
| 5,259,093 | * | 11/1993 | D'Annunzio | 224/674 X |
| 5,526,924 | * | 6/1996 | Klutznick | 224/250 X |
| 5,570,824 | * | 11/1996 | Lyon et al. | 224/675 X |
| 5,603,591 | * | 2/1997 | McLellan | 24/442 X |
| 5,604,961 | * | 2/1997 | Cole | 24/306 |
| 5,676,293 | * | 10/1997 | Farris | 224/576 |
| 5,724,707 | * | 3/1998 | Kirk et al. | 224/675 X |
| 5,983,403 | * | 11/1999 | Neeley | 2/338 |

FOREIGN PATENT DOCUMENTS

| | | | | |
|---|---|---|---|---|
| 1161406 | * | 6/1968 | (GB) | 24/306 |
| 1529120 | * | 6/1968 | (FR) | 24/30.5 P |

* cited by examiner

*Primary Examiner*—Gregory M. Vidovich
(74) *Attorney, Agent, or Firm*—E. Russell Tarleton; SEED IP Law Group PLLC

(57) ABSTRACT

A strap attachment system having a stiffened flexible strap with a first end anchored to a pouch and a free end configured for positioning around a belt and releasable attachment to the pouch, such as with hook-and-loop fasteners. The stiffened flexible strap is formed from webbing that has the hook portion of the hook-and-loop fastening system attached thereto, preferably by stitching. A stiffener having a shaped end is positioned between the hook portion and the webbing to provide some rigidity to the webbing. The stiffened flexible strap is more easily threaded around a belt to form a connecting loop.

9 Claims, 1 Drawing Sheet

STRAP ATTACHMENT SYSTEM

CROSS-REFERENCE TO RELATED APPLICATION

This application claims priority from U.S. Provisional Patent Application No. 60/095,819, filed Aug. 6, 1998, entitled "STRAP ATTACHMENT SYSTEM."

TECHNICAL FIELD

The present invention is directed to a system for connecting article holders to a support, and, more particularly, to a strap attachment system for connecting pouches, containers, bottle holders, holsters, and other objects to belts, such as a pants belt, and straps, such as a compression strap on a backpack, with stiffened flexible strap.

BACKGROUND OF THE INVENTION

Article holders such as pouches, bottle holders, small camera cases, holsters, and the like are frequently connected to a support such as a user's pants belt or a compression strap on a backpack. While a variety of methods exist for connecting an article holder to a belt or strap, the most common is to use fabric loops sewn to the back of the article holder through which the belt or strap is threaded so that the article holder is suspended from or supported by the belt by the loops.

An improvement over the foregoing is to have each loop formed from a fabric or webbing strap having one end sewn to the article holder and the other end releasably attached to the article holder via conventional means, ie., snaps, buckles, or hook-and-loop fastener. This enables a user to open the loops, push the free ends behind the belt, and easily reclose the loop. This is not only more convenient than undoing a belt, but it also permits the article holder to be connected to an object that may not have a free end to be threaded through loops. Thus, a flexible strap having one end that can be threaded around a belt offers a major advantage over those sewn down at both ends.

One disadvantage of using flexible straps is that it is usually difficult to thread the free end of the strap behind a belt or a pack strap that is tightly pressed against a body or backpack. Thus, there is a need for an attachment system that facilitates positioning a strap around a belt or other support.

SUMMARY OF THE INVENTION

A strap attachment system is provided for connecting an object to a belt or strap, the system including a flexible strap having one end anchored to the object and a stiffening member affixed along the flexible strap to facilitate insertion of the stiffening member between belts or straps and a surface against which the belts or straps are tightly pressed. Ideally, the stiffening member has a shaped free end to enable easy insertion between the belts or straps and the surface.

In accordance with another aspect of the invention, the shaped end of the stiffening member is tapered down at the free end and a lip is formed at the opposite end of the taper where the flexible strap is attached thus presenting a smooth outer surface where the flexible strap meets the stiffening member.

DETAILED DESCRIPTION OF THE INVENTION

Figure 1:
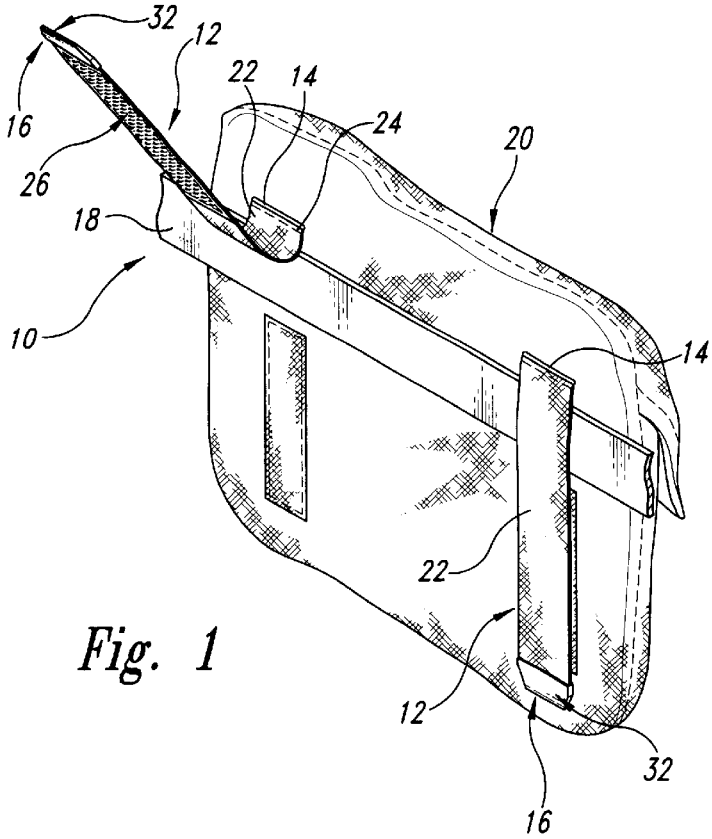
FIG. 1 is an isometric projection of a strap attachment system used in connection with pouches as formed in accordance with the present invention.
Figure 2:
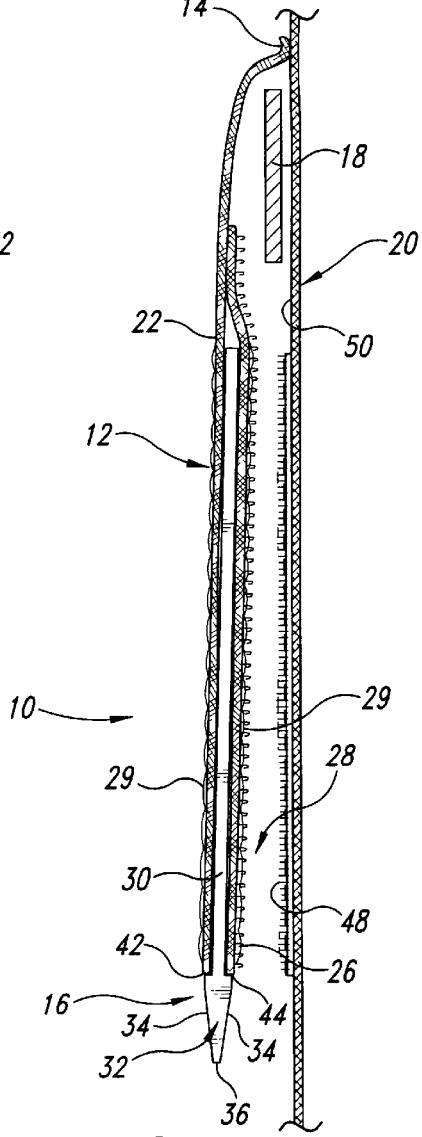
FIG. 2 is a cross-sectional view of a stiffened attachment strap formed in accordance with the present invention.

FIGS. 1 and 2 illustrate a strap attachment system 10 formed in accordance with the present invention. The system 10 includes a flexible strap 12 having a first end 14 anchored or attached to a pouch 20 and a free end 16 looped or positioned around a belt 18. It is to be understood that the pouch 20 could comprise a wide variety of article holders, including water bottle holders, holsters, small camera cases, belt pouches, etc., all of which are among a great variety of objects that are frequently provided with attachment loops. It is to be further understood that the belt 18 is one representation of an object to which the strap attachment system 10 can be connected. Other objects include compression straps on backpacks, short strips of webbing, ropes, chains, small rails or racks, and the like. Thus, the invention is not to be limited by the examples of the objects to be suspended or the structural member that the strap attachment system 10 can be attached to.

The free end 16 is releasably attached to the pouch 20 by conventional means, such as hook-and-loop fasteners, although other means may be used, such as snaps, buttons, buckles, and the like.

The flexible strap 12 is formed from webbing 22 that generally consists of a flexible filament used to construct straps for outdoor equipment and use, as is well known in the trade. The first end 14 is preferably fixedly attached to the pouch 20, such as by stitching 24, although other means may be used that provides a strong and reliable attachment to the pouch 20, such as adhesive, fusion by heat, rivets, etc. In this particular representation, the free end 16 of the webbing 22 has the hook portion 26 of a hook-and-loop fastening system 28 attached thereto, preferably by stitching 29. A stiffener 30 is positioned between the hook portion 26 and the webbing 22 at the free end 16 to provide some rigidity to the free end 16. As shown more clearly in FIG. 2, the stiffener 30 is attached to the webbing 12 and the hook portion 26 by the stitching 29. In other words, the stitching 29 goes through the stiffener 30 as well as the hook portion 26 and webbing 22. It is to be understood, however, that other attachment methods can be used, such as adhesives, rivets, and the like.

An alternative method for mounting the stiffener on the webbing is to form a pocket between the hook portion 26 and webbing 32 by sewing around three sides of the hook portion 26 and the webbing 22, leaving one side open through which the stiffener 30 is inserted. The open side could then be sewn shut. A sleeve having open ends could also be used, and one or both ends could be sewn shut, in which case the stitching could pass through the stiffener 30 to more firmly hold the stiffener 30 to the strap 12.

Ideally, the stiffener 30 is manufactured from a plastic material that is sufficiently thin to permit a commercial sewing needle to pass therethrough along with thread to form the stitching 29. While the stiffener 30 has rigidity, it is sufficiently flexible to permit a limited amount of bending. It is to be understood that the stiffener 30 may also be formed of metal, wood, or other suitable material that ideally has some flexibility or is somewhat bendable or semi-rigid. In the case of metal or wood, attachment to the webbing 22 and hook portion 26 could be accomplished by other attaching means, such as adhesive.

Figure 3:
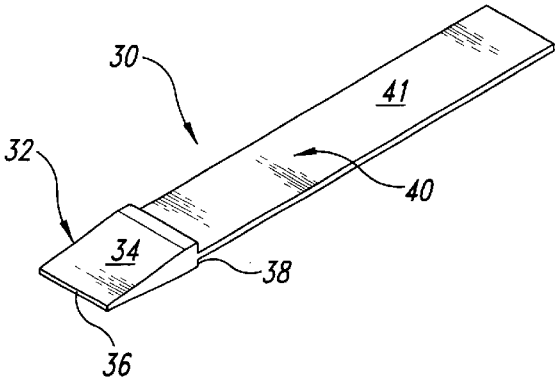
FIG. 3 is an isometric projection of stiffener formed in accordance with the present invention.

As shown more clearly in FIG. 3, the stiffener 30 has a substantially planar body 40. A barbed head 32 may be integrally formed thereon. The barbed head 32 comprises two planar sides 34 that converge together at one end to form a point 36 and diverge at the other end to form a shoulder 38 that projects beyond the planar sides 41 of the stiffener 30. Ideally, as shown in FIGS. 1 and 2, the barbed head 32 is not covered with the webbing 22 and hook portion 26.

The shoulder 38 formed by the barbed head 32 enables the ends 42 and 44 of the webbing 22 and hook portion 26, respectively, to be positioned flush against the shoulder 38 on the barbed head 32, so that the webbing 22 and the hook portion 26 that forms a flat outer surface and presents a smooth transition to the converging planar sides 34 of the barbed head 32. This prevents the ends 42, 44 of the webbing 22 and hook portion 26, respectively, from catching on the user's belt 18 or pants as the stiffened flexible strap 12 is threaded around the belt 18.

The loop portion 48 of the hook-and-loop fastening system is attached to the outside surface 50 of the pouch 20 and positioned to mate with the hook portion 26 on the corresponding stiffened flexible strap 12.

In use, the free end 16 of the stiffened flexible strap 12 is detached from the pouch 20, by pulling the hook portion 26 away from the loop portion 40. The free end 16 is threaded around the belt 18, and then reattached to the loop portion 48 on the pouch 20 to form a closed loop around the belt 18. To release the pouch 20, the steps are reversed, i.e., the free end 16 is pulled away from the pouch 20, thus pulling the hook portion 26 away from the loop portion 48, and the strap 12 is pulled away from the belt 18. The flush mounting of the webbing 22 and hook portion 26 on the stiffener 30 prevents both the shoulders 38 on the stiffener 30 and the ends 42 and 44 of the webbing 22 and hook portion 26, respectively, from catching on the belt 18 or the pants.

While a preferred embodiment of the invention has been illustrated and described, it is to be understood that various changes may be made therein without departing from the spirit and scope of the invention. For example, the hook portion 26 and loop portion 48 may be interchanged. In addition, the stiffener 30 may be constructed without the shoulders 38. Also, the stiffener 30 can be attached to the webbing 22 by means of rivets or other fasteners, as can be the first end 14 of the webbing 22 to the pouch 20. Further, the stiffener 30 may be adhesively affixed to either the hook portion 26, the webbing 22, or both, with suitable adhesive such as a glue, as is commercially in the art. Thus, the present invention is to be limited only by the scope of the claims that follow.

What is claimed is:

1. A system for attaching an object to a belt or strap that is pressed against a surface, comprising: a flexible strap member having a first end adapted to be anchored to the object, and a second end; and a stiffening member attached along the flexible strap member, the stiffening member having a shaped insertion end extending beyond the flexible strap member to facilitate insertion of the second end of the flexible strap member between the belt or strap and the surface, the stiffening member including a first connection member configured for releasable connection to a second connection member adapted to be affixed to the object, wherein the first and second connection members comprise hook-and-loop fastener.

2. An attachment system, comprising:

an object, the object including a first connecting member;

a flexible strap member having a first end anchored to the object and a second end; and a stiffening member on the flexible strap member, the stiffening member having a rigidity greater than the rigidity of the flexible strap member, the stiffening member comprising a body attached to the flexible strap member, the body including a second connecting member configured for releasable attachment to the first connecting member, and an insertion end extending from the body and beyond the second end of the flexible strap member, the insertion end shaped to facilitate insertion of the flexible strap member and attached stiffening member with second connecting member between tightly pressed surfaces, wherein the body of the stiffening member comprises a strap of material having first and second planar surfaces and having a length greater than a width and the width greater than a thickness and wherein the insertion end of the stiffening member tapers to a chisel point away from the body and is thicker than the body where it joins the body thus forming shoulders on the first and second surfaces where the insertion end joins the body.

3. The system of claim 2 wherein the shoulders are sized and shaped to accommodate the thickness of the flexible strap member so as to minimize any difference between the maximum thickness of the insertion end and a total thickness of the flexible strap member plus the body of the stiffening member, thereby facilitating insertion between tightly pressed surfaces.

4. The system of claim 2 wherein the shoulders are sized and shaped to accommodate the thickness of the flexible strap member and the thickness of the second connecting member that releasably connects the stiffening member to the first connecting member to minimize any difference between the maximum thickness of the insertion end and a total thickness of the flexible strap member plus the second connecting member plus the body of the stiffening member, thereby facilitating insertion between tightly pressed surfaces.

5. The system of claim 2 wherein the first planar surface of the stiffening member is attached to the flexible strap member, and the shoulder on the first planar surface of the stiffening member is sized and shaped to accommodate the thickness of the flexible strap member, and wherein the second connecting member comprises a strip of hook-and-loop fastener attached to the second planar surface of the stiffening member for releasable connection to the first connecting member, and the shoulder on the second planar surface of the stiffening member is sized and shaped to accommodate the thickness of the hook-and-loop fastener to minimize any difference between the maximum thickness of the insertion end and the total thickness of the flexible strap member plus the hook-and-loop fastener plus the body of the stiffening member, thereby facilitating insertion between tightly pressed surfaces.

6. An attachment system, comprising:

an object having a connecting member formed thereon;

a flexible strap member having a first end anchored to the object and a second end;

a stiffening member having a body attached along the flexible strap member and having an insertion end that extends beyond the second end of the flexible strap member, the insertion end formed by first and second planar surfaces that slope together in a direction away from the body to form an insertion edge and that slope apart to form shoulders where the insertion end joins the body; and a releasable connecting device attached to the stiffening member for connecting the second end of the flexible strap member to the connecting member on the object to form a loop such that the object can be suspended from a belt or strap that is tightly pressed against a surface.

7. The system of claim 6 wherein the stiffening member is formed of a flexible, resilient material to enable bending of the stiffening member and to facilitate passing of the flexible strap member between tightly-pressed surfaces.

8. The system of claim 6 wherein the releasable connecting device and the connecting member comprise hook-and-loop fastener.

9. The system of claim 6 wherein the stiffening member is formed of material that enables a needle with accompanying thread to be passed through the flexible strap member and the stiffening member to attach the flexible strap member to the stiffening member.

* * * * *

UNITED STATES PATENT AND TRADEMARK OFFICE

CERTIFICATE OF CORRECTION

PATENT NO. : 6,279,804 B1
DATED : August 28, 2001
INVENTOR(S) : Ron Gregg

It is certified that error appears in the above-identified patent and that said Letters Patent is hereby corrected as shown below:

Column 6, claim 8,
Line 1, "The system of claim 6" should read -- The system of claim 7 --.

Column 6, claim 9,
Line 4, "The system of claim 6" should read -- The system of claim 7 --.

Signed and Sealed this

Eighteenth Day of December, 2001

*Attest:*

*Attesting Officer*

JAMES E. ROGAN
*Director of the United States Patent and Trademark Office*